United States Patent [19]

Yairi

[11] Patent Number: 4,807,508

[45] Date of Patent: Feb. 28, 1989

[54] DIRECT COUPLED BRIDGE CONSTRUCTION FOR ACOUSTIC STRINGED INSTRUMENTS

[75] Inventor: Kazuo Yairi, Kani, Japan

[73] Assignee: St. Louis Music Supply Company, St. Louis, Mo.

[21] Appl. No.: 121,605

[22] Filed: Nov. 17, 1987

[30] Foreign Application Priority Data

Nov. 25, 1986 [JP] Japan ..... 61-280442

[51] Int. Cl.[4] ..... G10D 3/00

[52] U.S. Cl. ..... 84/297 R; 84/299

[58] Field of Search ..... 84/297 R, 267, 298, 84/299, 291, 307, 302

[56] References Cited

U.S. PATENT DOCUMENTS 493,810 3/1893 Becker ..... 84/299

976,428 11/1910 Benson et al. ..... 84/298

*Primary Examiner*—Michael L. Gellner

*Assistant Examiner*—Brian W. Brown

*Attorney, Agent, or Firm*—Senniger, Powers, Leavitt and Roedel

[57] ABSTRACT

This invention relates to an acoustic stringed instrument having a resonance body, characterized in that an elongated opening is formed on the surface of a surface plate of the resonance body in its transverse direction, a bridge number to which one of the ends of each string is fixed and which has a protrusive sectional shape is fitted into the elongate opening in such a manner that only the protrusive portion of the lower bridge is exposed to the surface of the surface plate, and a step portion of the bridge number is bonded around the periphery of the elongate opening on the back of the surface plate.

12 Claims, 2 Drawing Sheets

DIRECT COUPLED BRIDGE CONSTRUCTION FOR ACOUSTIC STRINGED INSTRUMENTS

BACKGROUND OF THE INVENTION

This invention relates to guitars having a resonance body or a sounding box such as a folk guitar and a classic guitar and other acoustic stringed instruments.

Unlike so-called "electric guitars" providing electrically synthesized sound, guitars having a resonance body are characterized in that they produce natural or acoustic timbre. The timbre depends greatly on wood materials of a surface plate, side plates and the like that constitute the resonance body. Therefore, vibration of strings must be transmitted reliably to the surface plate through a lower bridge, but in the conventional guitars of this kind, the lower bridge is merely bonded to the surface of the surface plate by an adhesive.

While the strings are stretched for a long period of time, bonding power drops and the lower bridge peels off from the surface plate. It also peels off from the surface plate due to the difference of their expansion coefficients, and the surface plate is curved by the tensile force of the strings. Unless the bond surface of the lower bridge is sufficiently great, therefore, it cannot withstand the tensile force of the strings.

SUMMARY OF THE INVENTION

It is therefore among the objects of the present invention to provide a bridge construction for acoustic-type stringed instruments which reliably transmits vibrations from the strings to the surface plate; to provide such a bridge construction that is secured to the surface plate and will not separate therefrom, and to provide such a bridge construction that does not deform the surface plate.

The bridge construction for an acoustic stringed instrument according to the present invention comprises an opening in the surface plate of the resonance body and a bridge member comprising a protrusive portion adapted to protrude into the opening in the surface plate, and a step portion surrounding at least a portion of the protrusive portion and adapted to engage the underside surface of the surface plate adjacent the opening. The construction includes means for mounting the strings on the protrusive portion of the bridge member in the direction of its width.

The bridge member is firmly fixed to the surface plate and reliably transmits the vibration of strings to the surface plate. The tensile force of the strings actually pulls the bridge member against the surface plate, and thus the bridge construction eliminates the problem of the bridge separating from the surface plate.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
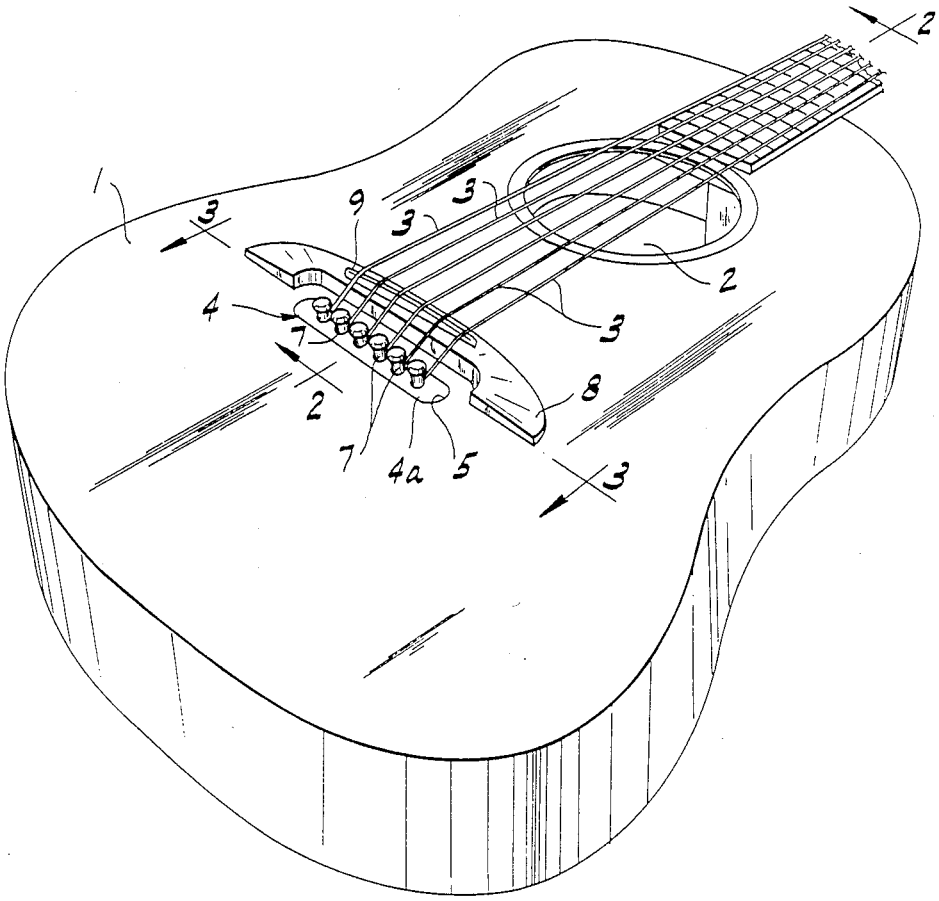
FIG. 1 is a perspective view of the body of a folk guitar incorporating the bridge construction of the present invention.
Figure 2:
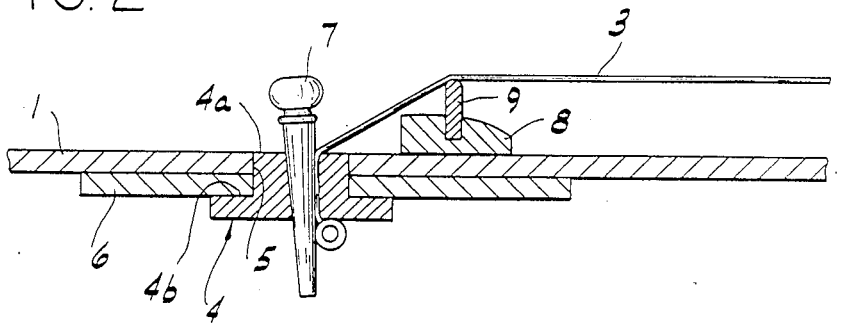
FIG. 2 is a longitudinal cross-sectional view of the bridge construction taken along the plane of line 2—2 in FIG. 1.
Figure 3:
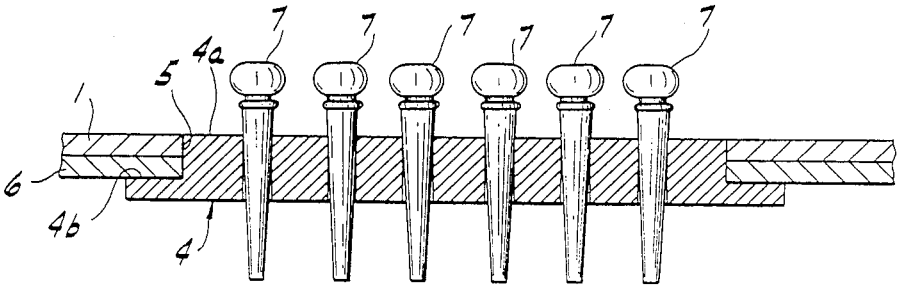
FIG. 3 is a transverse cross-sectional view of the bridge construction taken along the plane of line 3—3 in FIG. 1.

A preferred embodiment dealing with a folk guitar, by way of example, will be described with reference to the accompanying drawings. In the drawings, reference numeral 1 represents a surface plate of a resonance body, 2 is its sound hole and 3 are strings. Reference numeral 4 represents a bridge member for fixing one of the ends of each string 3. The bridge member 4 is formed by cutting out a stiff wood material such as an ebony in such a fashion that it has a protrusive sectional shape. The bridge member 4 is then fitted into an elongate opening 5, bored in the surface plate 1 so as to extend in the transverse direction of the surface plate 1, so that only the narrow portion **4*a* of the bridge member 4 is exposed to the surface of the surface plate 1. Reference numeral 6 represents a backing plate which is bonded around the periphery of the elongate opening 5 on the back of the surface plate 1. A step portion 4*b* of the bridge member 4 is bonded to the periphery of the elongate opening 5 on the back of the surface plate 1 while sandwiching the backing plate 6 between them. Reference numeral 7 represents end pins that are fitted in holes in the protrusive section 4a in order to fix the strings to the bridge member 4. Reference numeral 8 represents a pillow, which is disposed movably on the surface plate 1 and separately from the bridge member 4 and has a curved plane shape. This pillow, too, is made of a stiff wood material such as an ebony, and a bridge 9 made of stick-like resin material is put transversely on the upper surface of the pillow 8. The strings 3 bridge over this bridge 9 and are spaced apart from the surface of the surface plate 1**.

In the conventional folk guitars, the bridge is disposed integrally with the bridge member as is known in the art. Therefore, the bridge cannot move. In accordance with this embodiment, however, the pillow 8 is disposed separately from the bridge member 4 and the effective length of each string 3 can be adjusted as desired by a player by moving the pillow 8. Thus, delicate adjustment becomes possible. Furthermore, since the pillow 8 is disposed separately from the bridge member 4, it is possible to change the materials of the pillow and thereby change delicately the timbre inherent in the material employed.

As described above, in the acoustic stringed instrument in accordance with the present invention, the bridge member has a protrusive sectional shape and only its protrusive portion is fitted into the elongate opening 5 while its step portion **4*b* is bonded to the periphery of the elongate opening 5 on the back of the surface plate 1, thereby firmly integrating the bridge member to the surface plate. Therefore, the vibration of the strings is reliably transmitted to the surface plate 1, improving resonance. Moreover, the acoustic characteristics are improved. Deformation of the surface plate 1** and separation of the bridge from the surface plate due to the tensile force of the strings is eliminated.

What is claimed is:

1. An acoustic stringed instrument having a resonance body, characterized in that an elongated hole is formed on the surface of a surface plate of said resonance body in its transverse direction, a lower bridge to which one of the ends of each string is fixed and which has a protrusive sectional shape is fitted into said elongated hole in such a manner that only the narrow portion of said lower bridge is exposed to the surface of said surface plate, and a step portion of said lower bridge is bonded around the periphery of said elongated hole on the back of said surface plate.

2. A direct coupling bridge construction for mounting strings on the surface plate of an acoustic stringed instrument, the construction comprising:

an opening in the surface plate of the stringed instrument;

a bridge member comprising a protrusive portion adapted to protrude into the opening in the surface plate, and a step portion surrounding at least a portion of the protrusive portion and adapted to engage the underside of the surface plate adjacent the opening; and means for mounting strings to the protrusive portion of the bridge member.

3. The construction according to claim 2 further comprising a backing plate on the underside of the surface plate around the periphery of the opening, between the step portion and the underside of the surface plate.

4. The construction according to claim 2 wherein the opening is elongated perpendicular to the direction of the strings.

5. The construction according to claim 2 wherein the means for mounting the strings to the bridge member comprise holes in the protrusive portion of the bridge member and pins adapted to be frictionally fit in the holes to secure a string therein.

6. The construction according to claim 2 further comprising a pillow adapted to be supported on the surface plate to engage the strings and space them from the surface plate.

7. A direct coupled bridge construction for mounting strings on the surface plate of an acoustic stringed instrument, the construction comprising:

an elongate opening in the surface plate of the stringed instrument, generally perpendicular to the direction of the strings;

a backing plate on the underside surface of the surface plate;

a bridge member comprising a protrusive portion adapted to protrude into the opening in the surface plate, and a step portion having a surface relieved relative to the protrusive portion surrounding at least a portion of the protrusive portion and adapted for engaging the backing plate; and means for mounting strings to the protrusive section of the bridge member.

8. The construction according to claim 7 wherein the means for mounting the strings to the bridge member comprise holes in the protrusive portion of the bridge member and pins adapted to be frictionally fit in the holes to secure a string therein.

9. The construction according to claim 7 further comprising a pillow adapted to be supported on the surface plate to engage the strings and space them from the surface plate.

10. The construction according to claim 7 wherein the step section surrounds the protrusive portion on all sides, engaging the backing plate around the periphery of the opening.

11. The construction according to claim 7 wherein the backing plate is bonded to the underside of the surface plate with adhesive.

12. The construction according to claim 11 wherein the bridge member is bonded to the backing plate with adhesive.

* * * * *